US007131358B2

(12) United States Patent
Hsien

(10) Patent No.: US 7,131,358 B2
(45) Date of Patent: Nov. 7, 2006

(54) QUICK RELEASE DEVICE FOR RELEASING SCREW BIT FROM SOCKET

(76) Inventor: Chih-Ching Hsien, No. 367, Pei-Yang Rd., Feng Yuan, Taichung (TW)

( * ) Notice: Subject to any disclaimer, the term of this patent is extended or adjusted under 35 U.S.C. 154(b) by 0 days.

(21) Appl. No.: 11/328,124

(22) Filed: Jan. 10, 2006

(65) Prior Publication Data

US 2006/0107802 A1 May 25, 2006

Related U.S. Application Data

(62) Division of application No. 10/910,291, filed on Aug. 4, 2004.

(51) Int. Cl.
*B25B 13/06* (2006.01)

(52) U.S. Cl. ..... 81/438; 81/124.1; 81/124.7; 81/125; 279/155

(58) Field of Classification Search ..... 81/437–439, 81/124.1, 124.3, 124.7, 177.85, 125; 179/23.1, 179/155; 279/23.1, 155
See application file for complete search history.

(56) References Cited

U.S. PATENT DOCUMENTS

| | | | | |
|---|---|---|---|---|
| 1,317,455 | A * | 9/1919 | Perrine | 279/96 |
| 3,224,302 | A * | 12/1965 | Cooley, Sr. | 81/124.1 |
| 4,787,278 | A * | 11/1988 | Bononi | 81/438 |
| 5,819,606 | A * | 10/1998 | Arnold | 81/124.3 |
| 5,960,682 | A * | 10/1999 | Yamashita | 81/125 |
| 2002/0026859 | A1 * | 3/2002 | Suzuki | 81/121.1 |

* cited by examiner

*Primary Examiner*—D. S. Meislin

(57) ABSTRACT

A quick release bit socket assembly includes a socket and a screw bit is removably inserted in a first recess in a first end of the socket. A second recess is defined in a second end of the socket and a passage is in communication between the first and second recesses. A push rod includes a head and a shank which extends through the first recess, the passage and is inserted in the second recess. A spring is mounted to the shank and biased between the head and an inside of the first recess. The screw bit can be quickly pushed out from the second passage by pushing the push rod toward the screw bit.

2 Claims, 11 Drawing Sheets

QUICK RELEASE DEVICE FOR RELEASING SCREW BIT FROM SOCKET

FIELD OF THE INVENTION

This is a divisional application of applicant's former patent application with application Ser. No. 10/910,291, filed on Aug. 4, 2004.

BACKGROUND OF THE INVENTION

A conventional screw bit socket assembly is disclosed in FIG. 17, and generally includes a cruciform tube 30 and a positioning bead 31 extends inward from an inner periphery of the passage of the tube 30. A screw bit 40 has one end inserted into the passage and includes a notch defined in an outer periphery thereof so that the bead 31 is engaged with the notch to position the screw bit 40 in the passage. Nevertheless, when the screw bit 40 is to be removed from the passage. The user has to hold the screw bit 40 outside the tube 30 and pull the screw bit 40 in its longitudinal direction out from the tube 30. The screw bit 40 has a small diameter and the bead 31 is securely engaged with the notch, so that it is difficult to easily pull the screw bit 40 out from the passage. It could be worse when the user's hand is attached with grease.

The present invention intends to provide a quick release device which includes a push rod located at an end of the socket or tube opposite to the end with the screw bit being inserted. The screw bit is easily pushed out from the socket by pushing the push rod toward the screw bit.

SUMMARY OF THE INVENTION

The present invention relates to a quick release bit socket assembly which comprises a socket having a first recess for receiving a screw bit, and a second recess defined in a second end of the socket so as to receive a push rod. A passage is in communication between the first and second recesses. The push rod includes a head and a shank to which a spring is mounted. The shank extends through the first recess, the passage and is inserted in the second recess. The spring is biased between the head and an inner bottom of the first recess. The screw bit is positioned by a positioning device in the second recess and can be pushed out from the second recess when the push rod is pushed toward the screw bit.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 5:
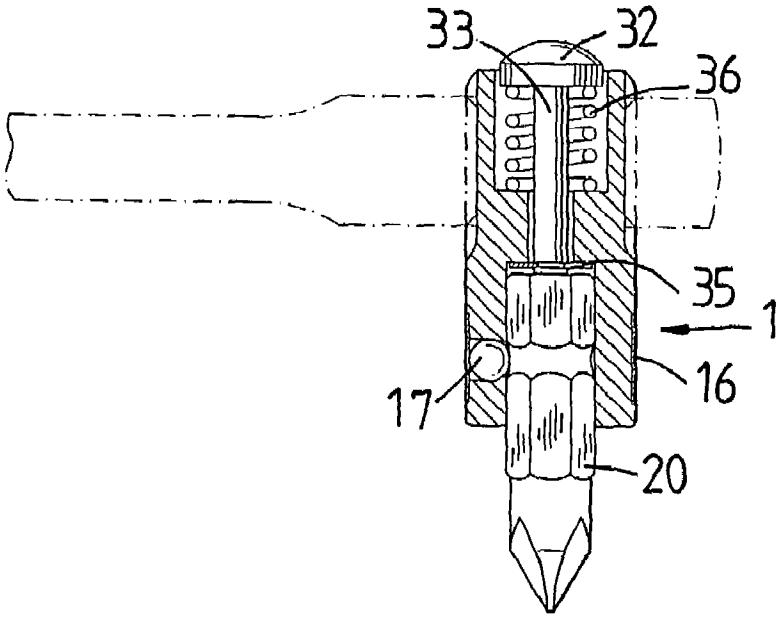
FIG. 5 is a cross sectional view to show that the quick release bit socket assembly of the present invention is connected to the ratchet wrench.
Figure 7:
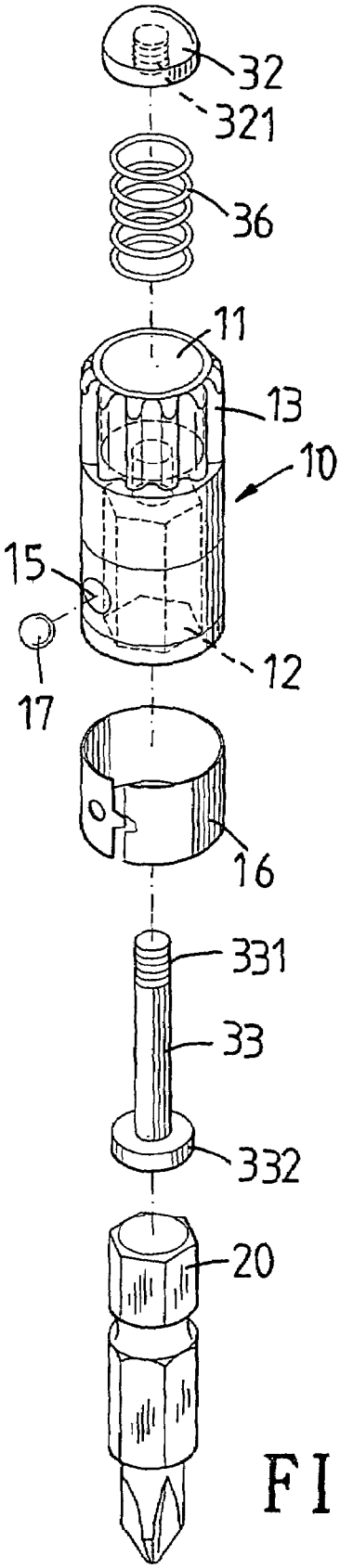
FIG. 7 is an exploded view to show a second embodiment of the quick release screw bit socket assembly of the present invention.
Figure 8:
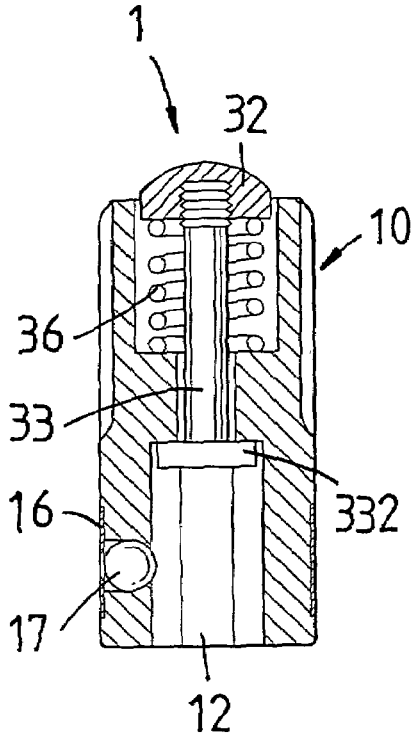
FIG. 8 is a cross sectional view to show a second embodiment of the quick release screw bit socket assembly of the present invention.
Figure 10:
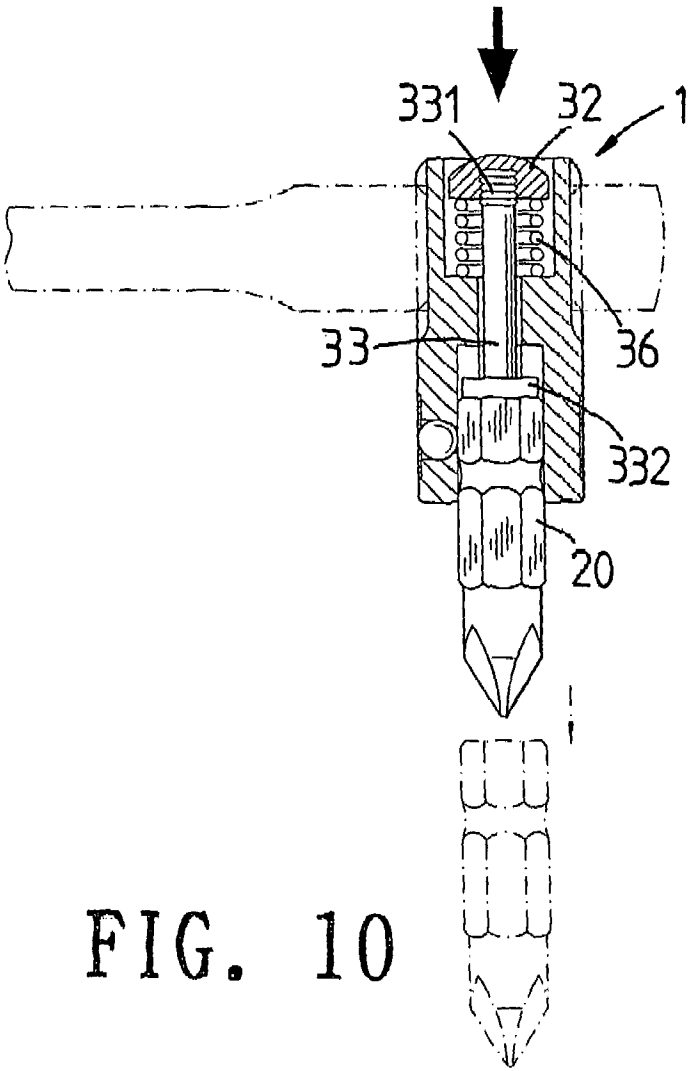
FIG. 10 is a cross sectional view to show that the screw bit of the second embodiment of the quick release bit socket assembly is pushed out from the socket by pushing the push rod.
Figure 9:
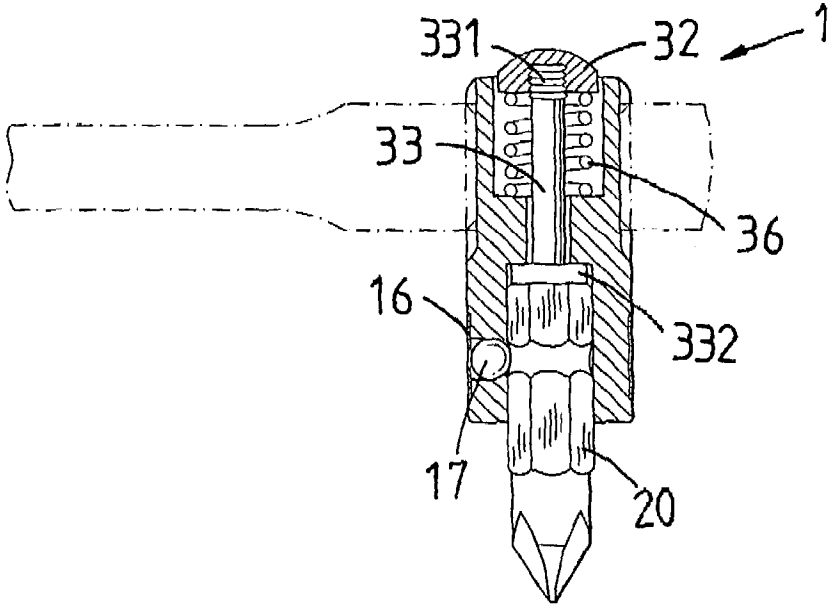
FIG. 9 is a cross sectional view to show that the second embodiment of the quick release bit socket assembly of the present invention is connected to the ratchet wrench.

Referring to FIGS. 1 to 5, the quick release bit socket assembly 1 of the present invention comprises a socket 10 which has a first recess 11 defined in a first end thereof and a second recess 12 is defined in a second end of the socket 10. The second recess 12 generally is a hexagonal recess so as to receive a screw bit 20. A positioning device such as a positioning bead 17 is engaged with a side hole 15 defined through a wall of the socket 10 and a part of the bead 17 extends into the second recess 12 and engaged with the groove in the screw bit 20. An annular recessed area 14 is defined in an outer surface of the socket 10 and located close to the second end of the socket 10. A strip 16 is engaged with the annular recessed area 14 and in flush with the outer surface of the socket 10 and seals the side hole 15. A passage is in communication between the first and second recesses 11, 12. The first end of the socket 10 includes a toothed outer surface 13 which is engaged with the engaging hole 51 of a ratchet wrench 50 as shown in FIG. 5.

A quick release device 30 includes a push rod 31 including a head 32 and a shank 33 which is connected to the head 32. A spring 36 is mounted to the shank 33 which extends through the first recess 11, the passage and is inserted in the second recess 12. A C-shaped clip 35 is engaged with a groove 34 defined in an outer surface of a distal end of the shank 33 so that the push rod 31 is positioned in place and the C-shaped clip 35 is clamped between the connection portion of the U-shaped strip and the distal end of the shank 33. The spring 36 is biased between the head 32 and an inside of the first recess 11.

Figure 1:
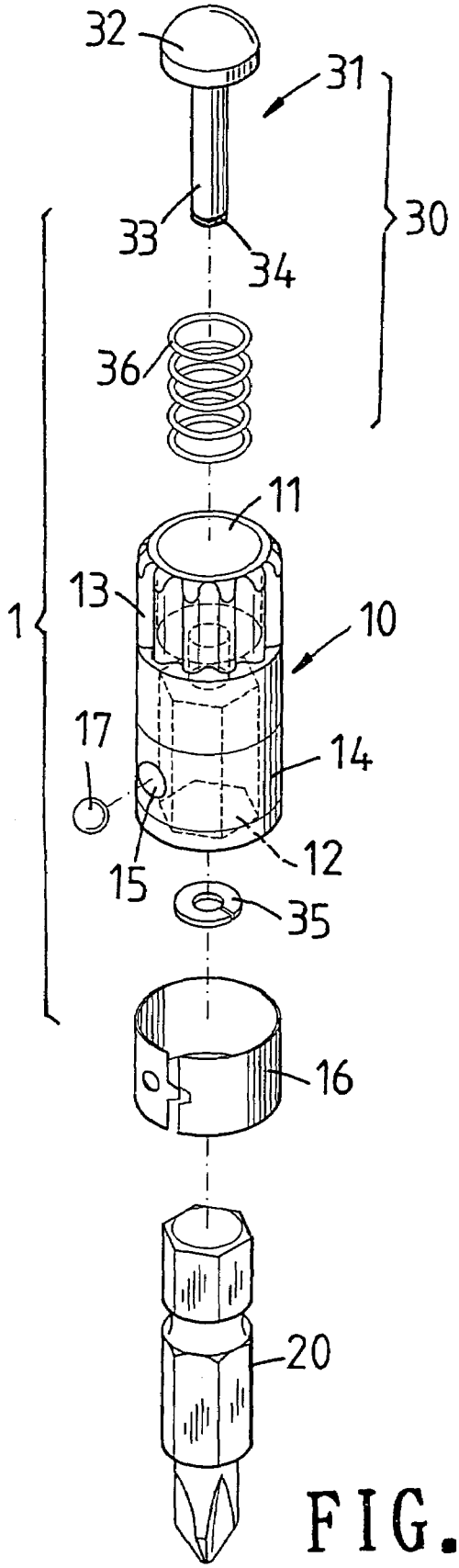
FIG. 1 is an exploded view to show a first embodiment of the quick release bit socket assembly of the present invention.
Figure 2:
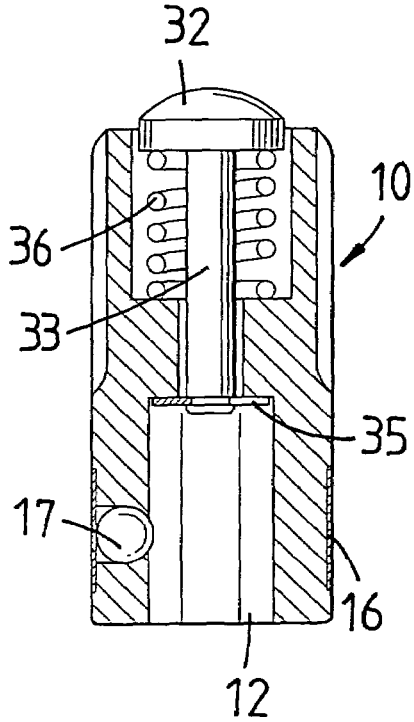
FIG. 2 is a cross sectional view to show the quick release bit socket assembly of the present invention.
Figure 3:
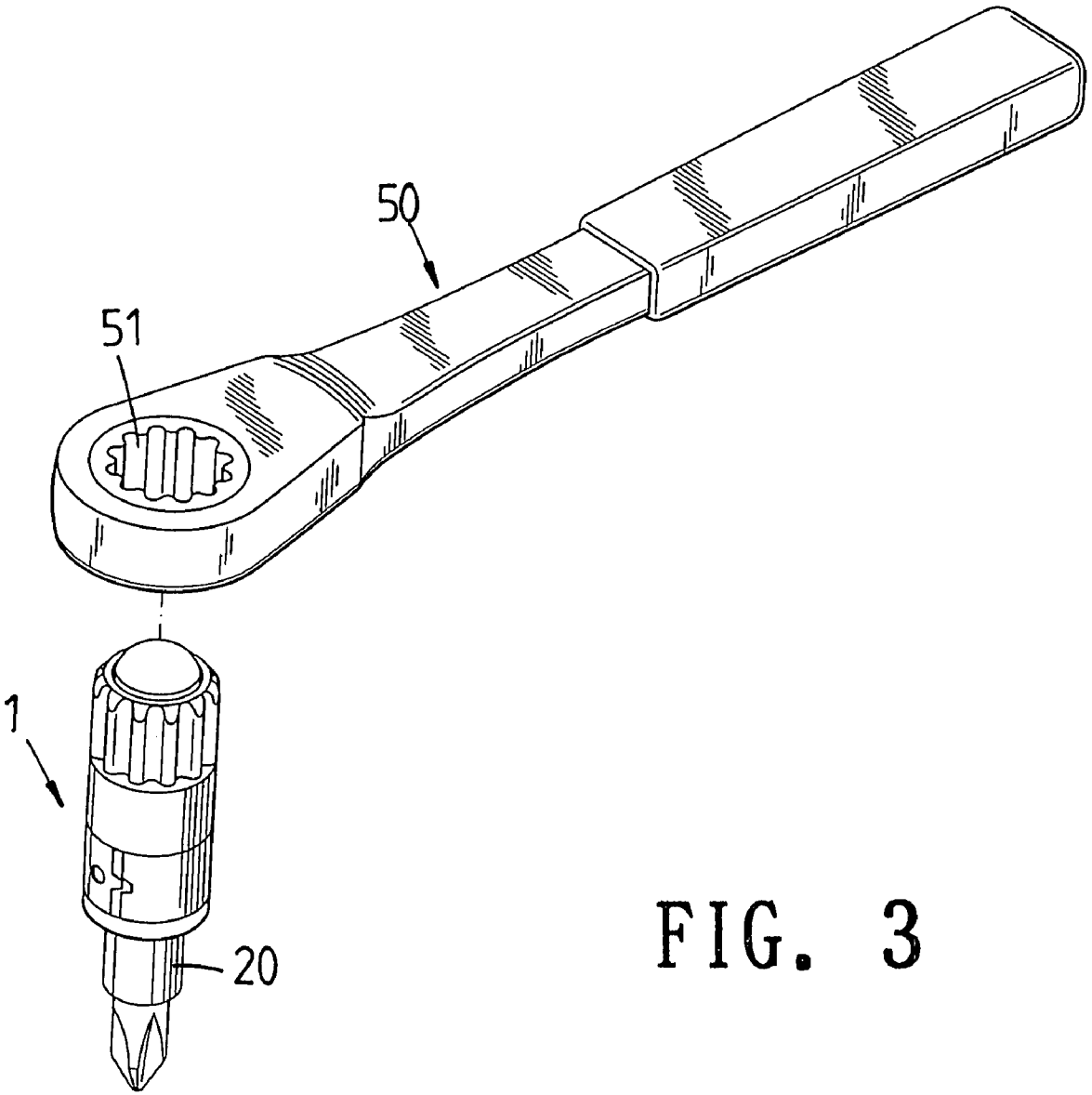
FIG. 3 shows the quick release bit socket assembly of the present invention and a ratchet wrench.
Figure 4:
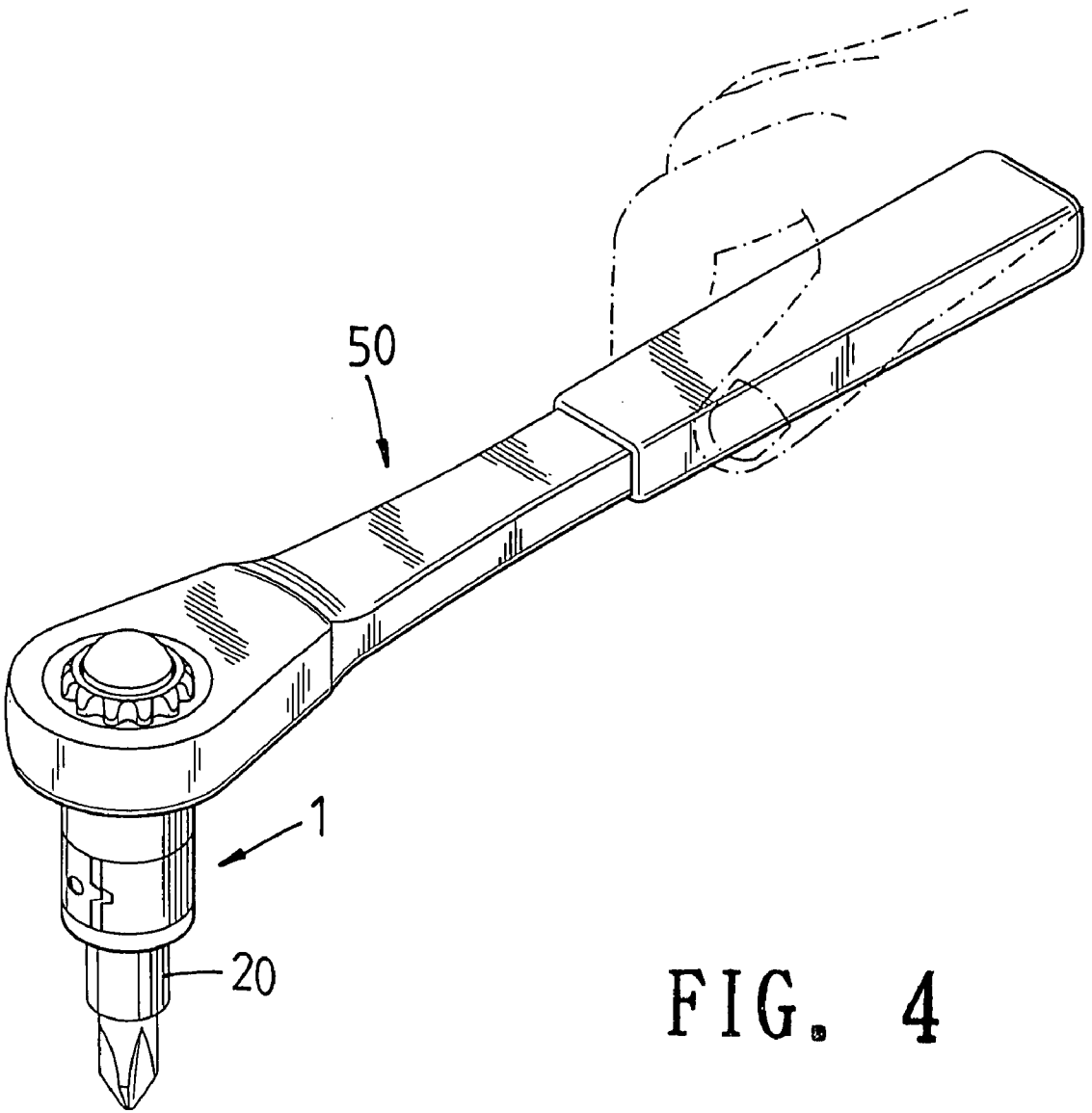
FIG. 4 shows the quick release bit socket assembly of the present invention connected to the ratchet wrench.
Figure 6:
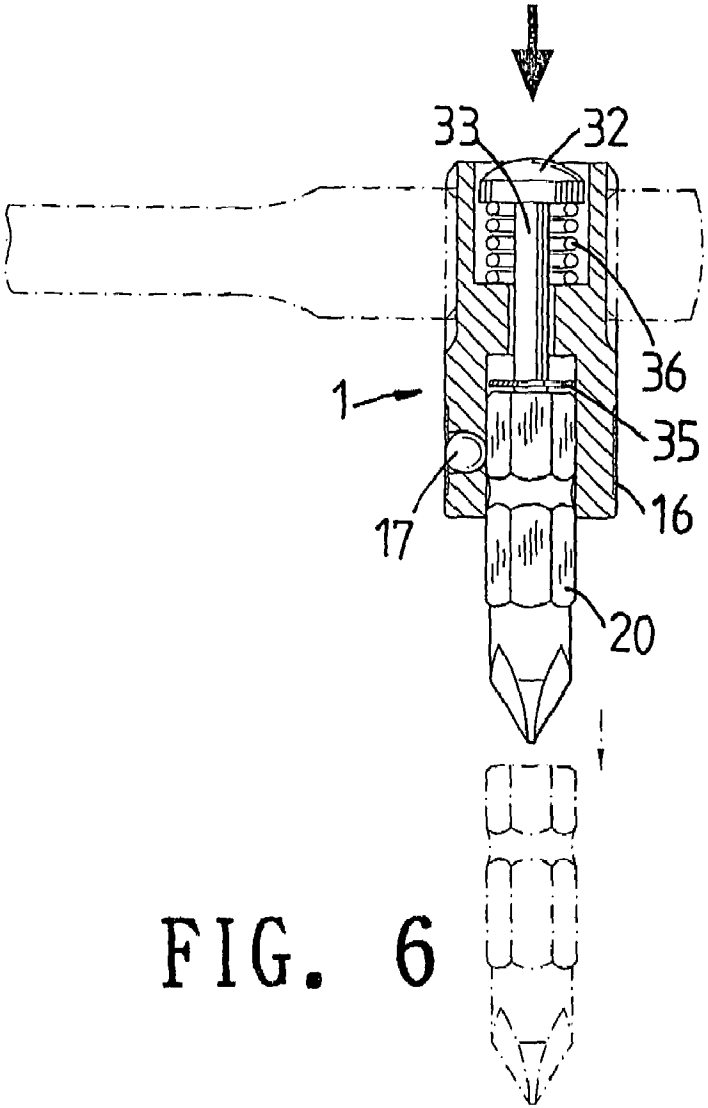
FIG. 6 is a cross sectional view to show that the screw bit is pushed out from the socket by pushing the push rod.

As shown in FIGS. 5 and 6, the user can easily pushes the head 32 of the push rod 31 toward the screw bit 20, the shank 33 is then lowered to push the screw bit 20 out from the second recess 12. By this way, the screw bit 20 can be easily separated from the socket 10.

FIGS. 7 to 10 show a second embodiment of the present invention, wherein the head 32 and the shank 33 are two separated pieces and the head 32 includes a threaded hole 321 defined in an underside thereof and the shank 33 has a threaded end 331 which extends through the second recess 12, the passage and the first recess 11 so as to be threadedly connected to the threaded hole 321 of the head 32. An enlarged portion 332 is connected to the other end opposite to the threaded end 331 to prevent the shank 33 from being pulled out from the first recess 11 of the socket 10.

Figure 11:
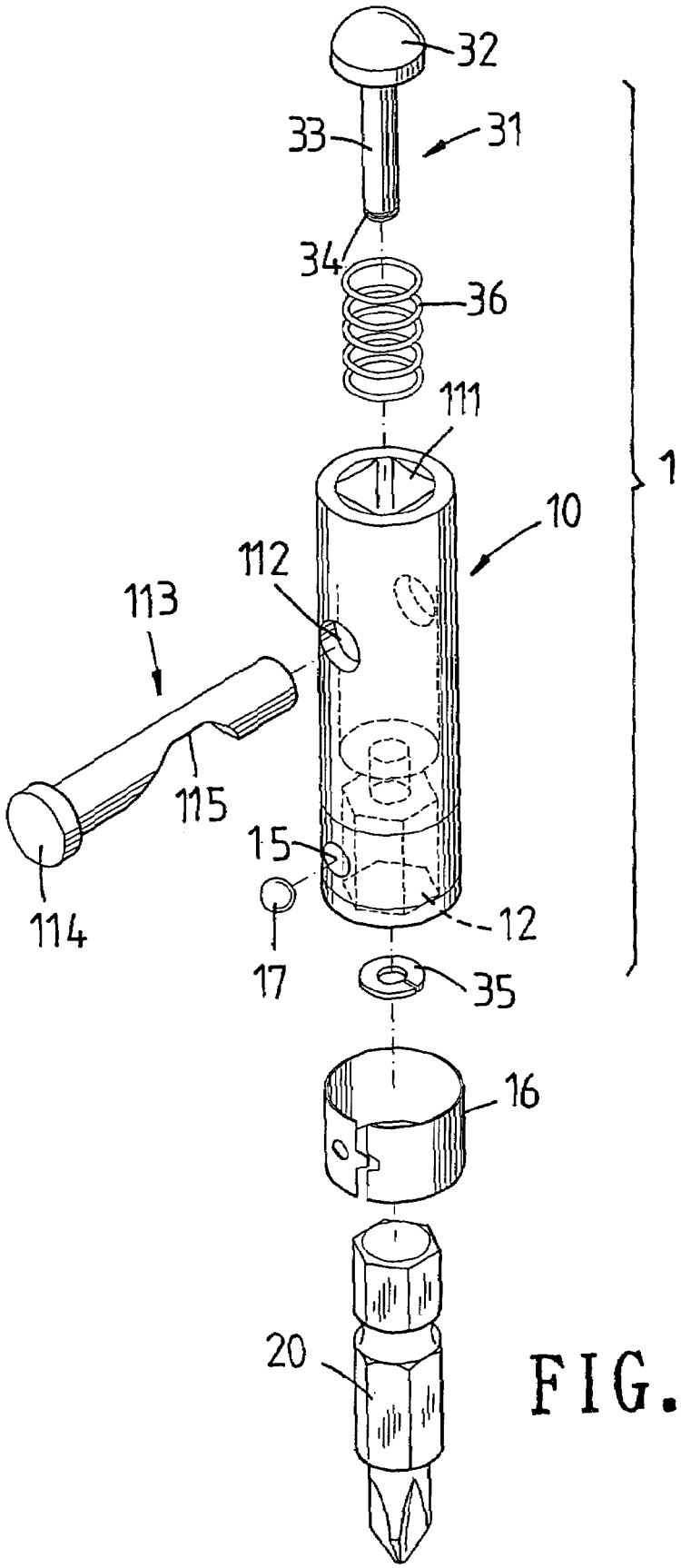
FIG. 11 is a cross sectional view to show a third embodiment of the quick release screw bit socket assembly of the present invention.
Figure 13:
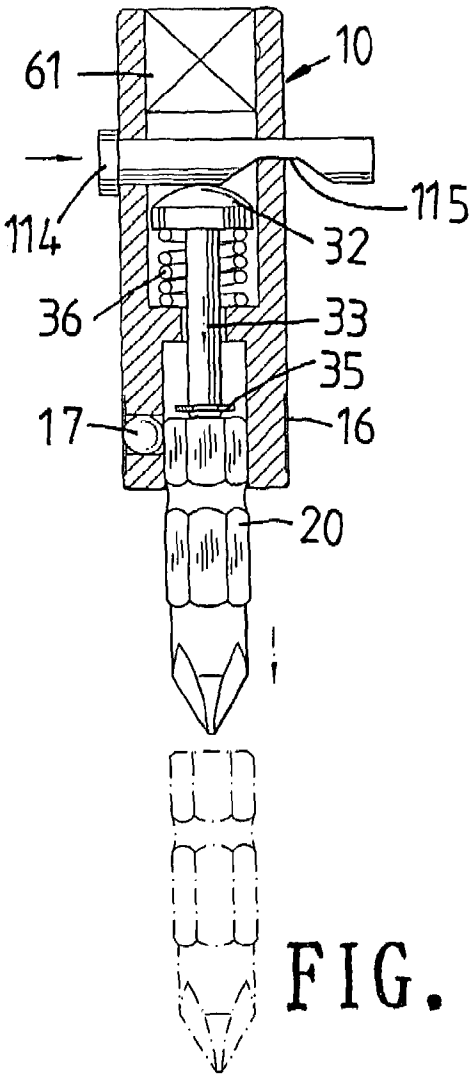
FIG. 13 is a cross sectional view to show that the screw bit of the third embodiment of the quick release bit socket assembly is pushed out from the socket by pushing the push rod.
Figure 12:
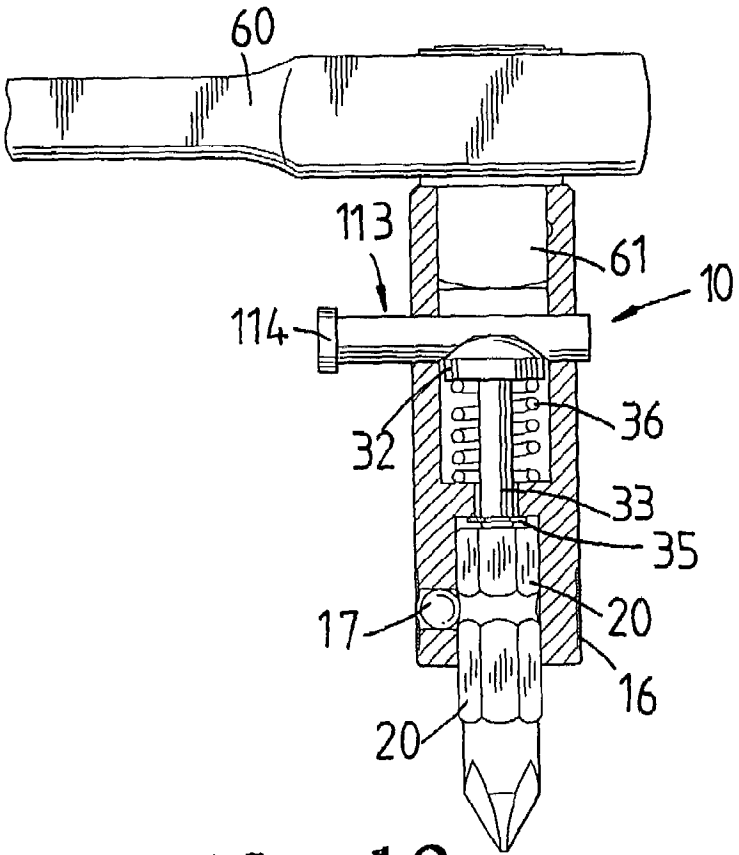
FIG. 12 is a cross sectional view to show that the third embodiment of the quick release bit socket assembly of the present invention is connected to the ratchet wrench.

FIGS. 11 to 13 show a second embodiment of the present invention, wherein a push bar 113 transversely and movably extends through holes 112 defined through the wall of the socket 10 and has a reception recess 115 defined radially in an outer surface thereof. A head 114 is connected to an end of the push bar 113 so as to prevent the push bar 113 from being pulled out from the socket 10. The head 32 of the push rod 31 is engaged with the reception recess 116, so that the push rod 31 is pushed toward the second recess 12 when the push bar 113 is transversely moved. The first recess of the socket 10 is a polygonal recess 111 so as to receive a drive shaft 61 of a wrench to rotate the socket 10.

Figure 14:
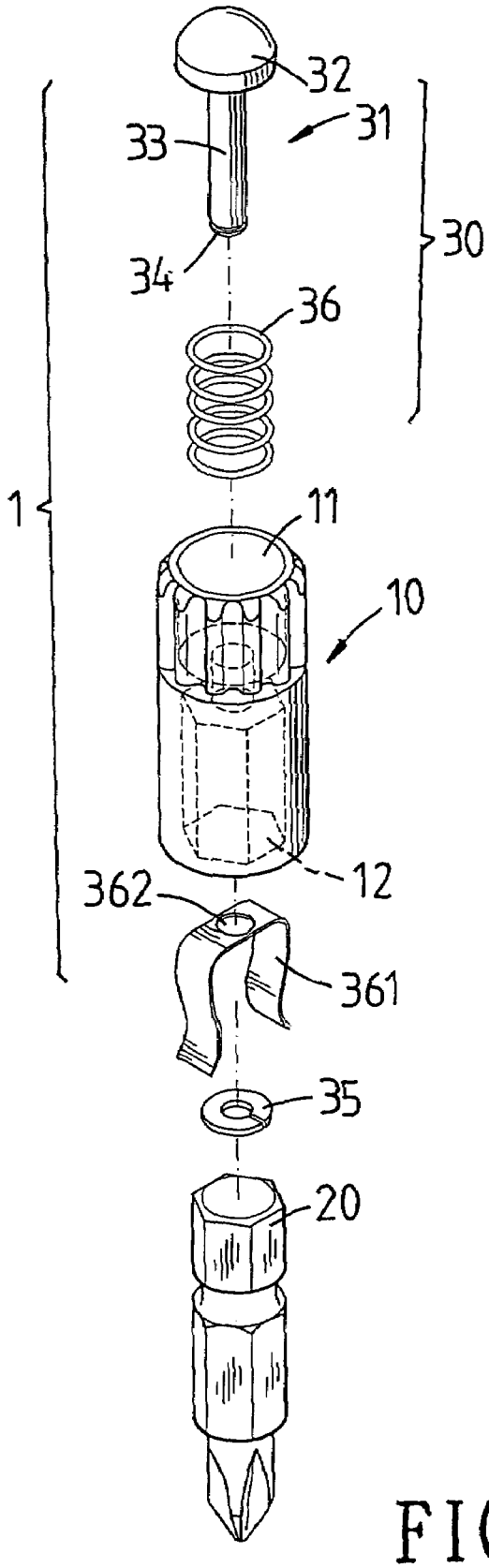
FIG. 14 discloses another embodiment of the positioning device for positioning the screw bit.
Figure 16:
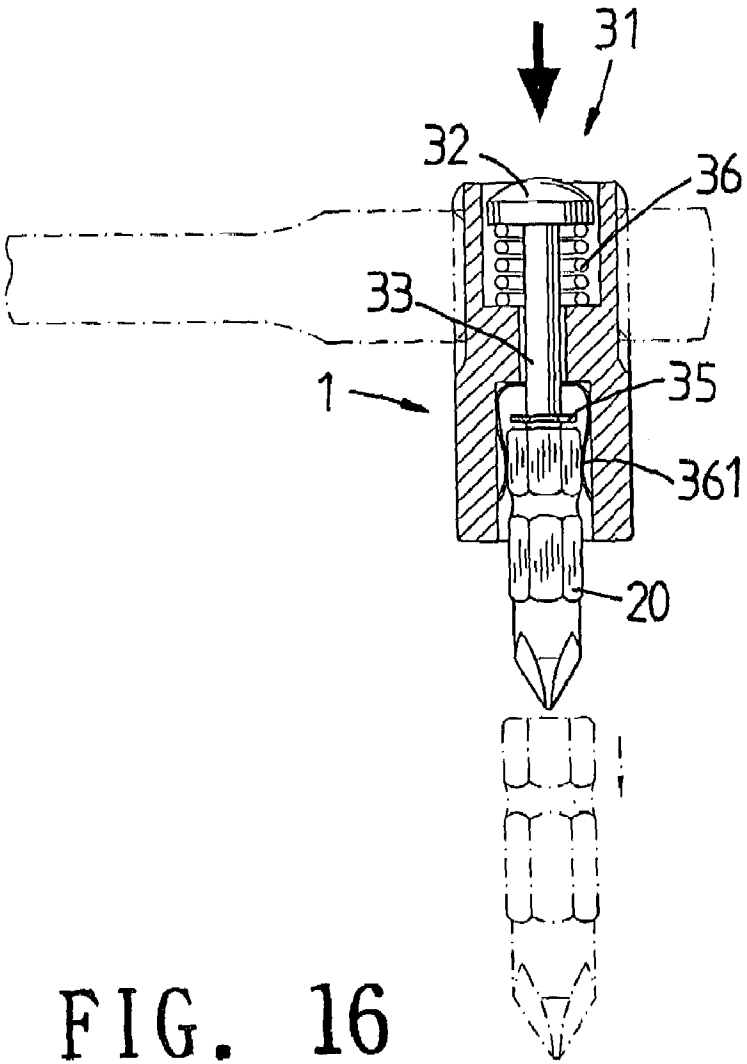
FIG. 16 is a cross sectional view to show that the screw bit is pushed out from the socket in FIG. 15.
Figure 15:
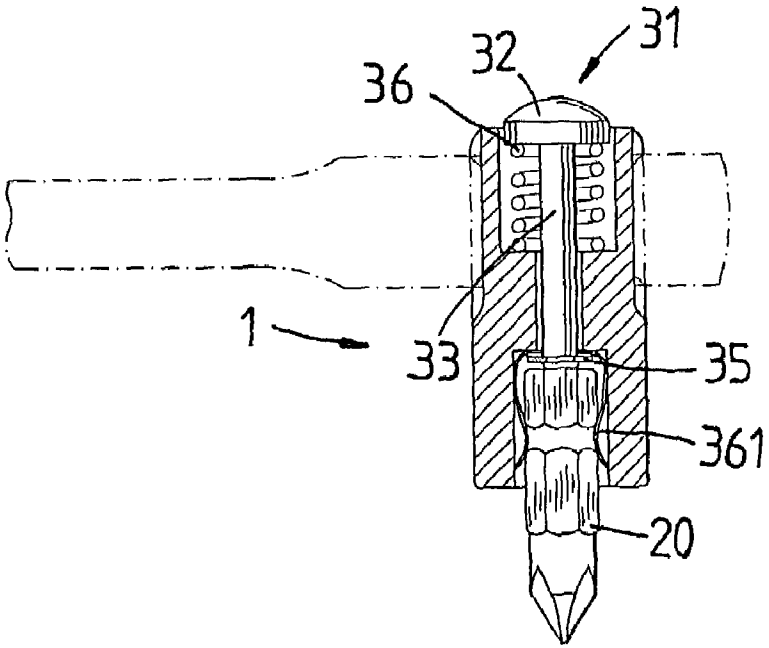
FIG. 15 is a cross sectional view to show that the quick release bit socket assembly with the positioning device in FIG. 14 is connected to the ratchet wrench.
Figure 17:
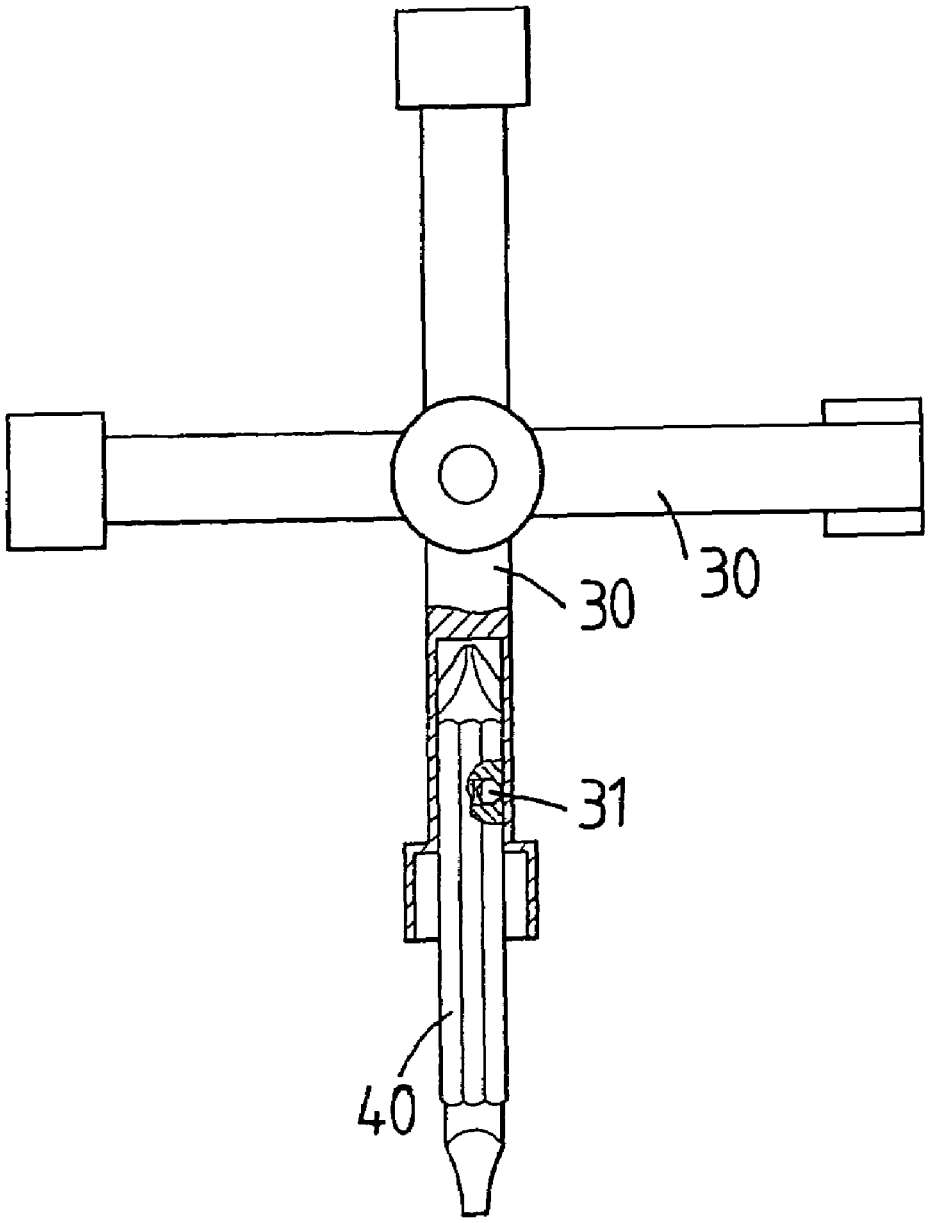
FIG. 17 PRIOR ART
FIG. 17 shows a conventional screw bit socket assembly.

FIGS. 14 to 16 show another embodiment of the positioning device of the present invention, wherein the positioning device is a U-shaped strip received in the second recess 12 and includes two legs 361 and a connection portion connected between the two legs 361. A hole 362 is defined through the connection portion and the shank 33 of the push rod 31 movably extends through the hole 362 in the connection portion. The two legs 361 each have an inward portion so that the screw bit 20 is clamped therebetween. When pushing the push rod 31, the shank 33 pushes the screw bit 20 which is then released from the inward portions of the two legs 361.

While we have shown and described the embodiment in accordance with the present invention, it should be clear to those skilled in the art that further embodiments may be made without departing from the scope of the present invention.

What is claimed is:

1. A quick release bit socket assembly comprising:

a socket having a first recess defined in a first end thereof, a second recess defined in a second end of the socket and a passage being in communication between the first and second recesses;

a push rod including a head and a shank connected to the head, a spring mounted to the shank which extends through the first recess, the passage and is inserted in the second recess, the spring biased between the head and a inside of the first recess;

a positioning device being a U-shaped strip which includes two legs and a connection portion through connected between the two legs, a hole defined through the connection portion and the shank of the push rod movably extending through the hole in the connection portion, a C-shaped clip engaged with a groove defined in an outer surface of a distal end of the shank, the C-shaped clip being clamped between the connection portion of the U-shaped strip and the distal end of the shank, the two legs each having an inward portion, and a screw bit removably inserted in the second recess and being clamped by the inward portions of the two legs of the positioning device in the second recess, the screw bit being pushed out from the second recess when the push rod is pushed toward the screw bit.

2. The assembly as claimed in claim 1, wherein the first end of the socket includes a toothed outer surface.

* * * * *